US005683135A

United States Patent [19]

Williams

[11] Patent Number: 5,683,135

[45] Date of Patent: Nov. 4, 1997

[54] COLLAPSIBLE TABLE AND CHAIR APPARATUS

[76] Inventor: Willis Ray Williams, 3129 Pinewood Dr., Arlington, Tex. 76010

[21] Appl. No.: 661,205

[22] Filed: Jun. 10, 1996

[51] Int. Cl.[6] ..... A47B 3/14

[52] U.S. Cl. ..... 297/159.1; 297/158.4; 108/118

[58] Field of Search ..... 297/159.1, 158.4; 108/35, 36, 118

[56] References Cited

U.S. PATENT DOCUMENTS

| | | | |
|---|---|---|---|
| 1,514,418 | 11/1924 | Battenfeld . | |
| 2,197,302 | 4/1940 | Goering . | |
| 2,257,550 | 9/1941 | Gay | 297/158.4 |
| 3,141,424 | 7/1964 | Seymour | 297/158.4 X |
| 3,427,069 | 2/1969 | McDonald . | |
| 3,580,632 | 5/1971 | Seymour | 297/158.4 |
| 3,692,358 | 9/1972 | Sung . | |
| 4,249,773 | 2/1981 | Giambalvo | 297/158.4 |
| 4,289,350 | 9/1981 | Thomas et al. . | |
| 4,700,987 | 10/1987 | Sraka et al. | 297/158.4 |
| 5,018,785 | 5/1991 | Monson et al. | 297/158.4 |

*Primary Examiner*—Peter R. Brown
*Attorney, Agent, or Firm*—Henderson & Sturm

[57] ABSTRACT

A collapsible table and chair apparatus 10 including a pair of table top halves 20, 21 pivotally associated with two pairs 32 and 33 of support legs that are pivotally secured to one another. A seat member 40 pivotally associated with one of the pairs 32 of support legs and provided with means 42 for maintaining the seat member 40 in a fixed position relative to the pair of support legs 32 when the apparatus 10 is deployed in the operative mode.

7 Claims, 2 Drawing Sheets

COLLAPSIBLE TABLE AND CHAIR APPARATUS

TECHNICAL FIELD

The present invention relates to the field of collapsible furniture in general, and in particular to a collapsible table and chair apparatus having a unique cooperation between the table top halves, the support legs and the seat member.

BACKGROUND ART

As can be seen by reference to the following U.S. Pat. Nos. 1,514,418; 2,197,302; 3,427,069; and 4,289,350, the prior art is replete with myriad and diverse collapsible furniture devices.

While all of the aforementioned prior art constructions are more than adequate for the basic purpose and function for which they have been specifically designed, they are uniformly deficient with respect to their failure to provide a simple, efficient, and compact arrangement for a collapsible table and chair apparatus, wherein the apparatus occupies the minimum possible storage space while not in use and which is very easy to deploy in its operative mode, while also providing a very stable platform surface for both the table and chair members.

As users of the existing prior art constructions are all to painfully aware, the currently available collapsible table and bench or chair arrangements are difficult to assemble, require too much storage space when not in use, and are difficult to transport from one location to another.

Educators in a limited space multi-use classroom environment and parents with pre-schoolers have long realized the benefit of having a well constructed collapsible table and chair apparatus that could be employed by young children for work, play, eating, studying, etc.

In addition, target shooters are always looking for collapsible shooting benches having a stable support for their firearms and accessories while also providing a comfortable seating arrangement.

As a consequence of the foregoing situation, there has existed a longstanding need for a new and improved collapsible table and chair apparatus that is simple to use, compact during storage, adapted for a variety of functional purposes, and provides extremely stable work and torso supporting surfaces for the user, and the provision of such a construction is a stated objective of the present invention.

DISCLOSURE OF THE INVENTION

Briefly stated, the collapsible table and chair apparatus that forms the basis of the present invention includes a table unit, a table support unit pivotally connected to the table unit, and a seat unit pivotally connected to the table support unit.

As will be explained in greater detail further on in the specification, the table support unit includes two pivotally connected pairs of support legs that comprise the primary support structure for the apparatus. Both pairs of support legs are elongated and extend beyond the table unit such that the seat unit which is pivotally associated with the elongated pairs of support legs can be spaced from the overhang of the table unit.

In addition, the apparatus is specifically designed and contoured to accommodate adjacent portions of the apparatus to produce the smallest possible apparatus profile during storage and/or transport. Furthermore, the various support arms and legs of the apparatus are spaced from one another such that they not only do not interfere with one another, but, in some instances captively surround each other to further diminish the apparatus profile.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
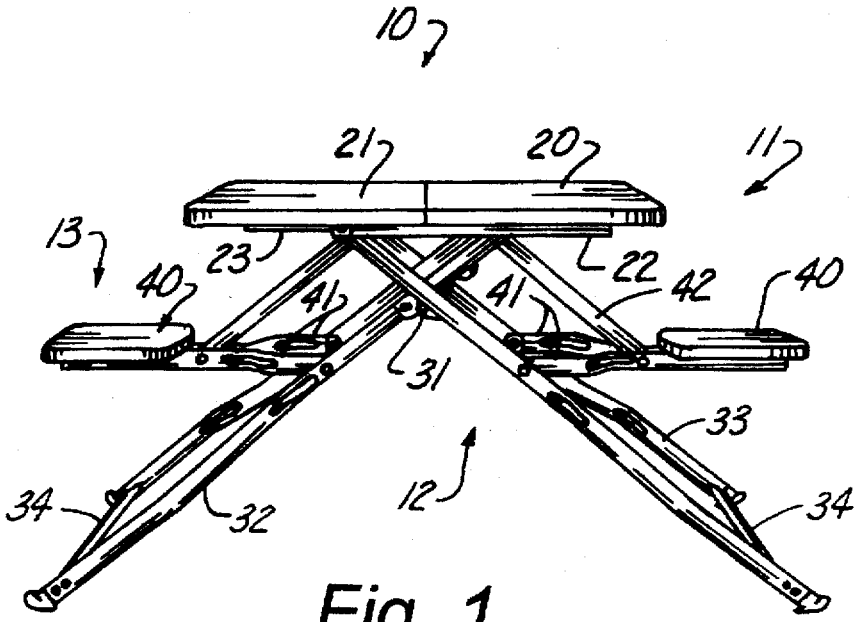
FIG. 1 is a perspective view of one version of the combined table and chair apparatus that forms the basis of the present invention deployed in its operative mode.

As can be seen by reference to the drawings, and in particular to FIG. 1, the collapsible table and chair apparatus that forms the basis of the present invention is designated generally by the reference numeral 10. The apparatus 10 comprises in general, a table unit 11, a table support unit 12, and a chair unit 13. These units will now be described in seriatim fashion.

As shown in FIGS. 1 thru 5, the table unit 11 comprises a pair of table top halves 20 and 21 wherein one table top half 20 is fixedly secured on the outboard end of a first pair of outer generally straight table support arms 22 and the other table top half 21 is fixedly secured on the outboard end of a second pair of inner contoured table support arms 23.

Figure 5:
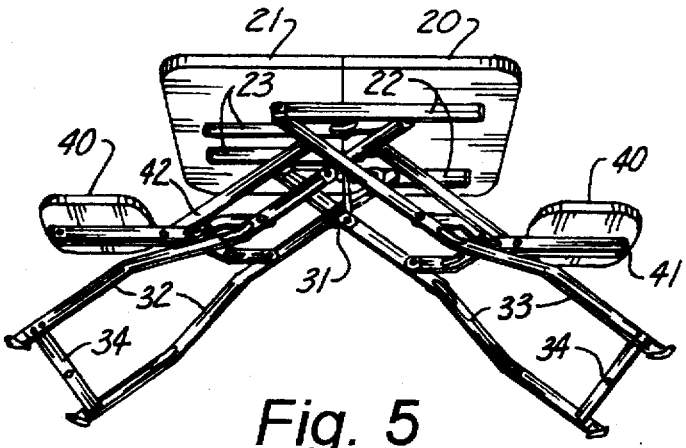
FIG. 5 is an above eye level perspective view of the first version of the invention in the operative mode.

In addition, as can best be seen by reference to FIG. 5, the outerboard ends of both pairs of table support arms 22, 23 substantially overlap the inboard ends of each other to provide substantial underlying support to the table top halves 20, 21.

Figure 3:
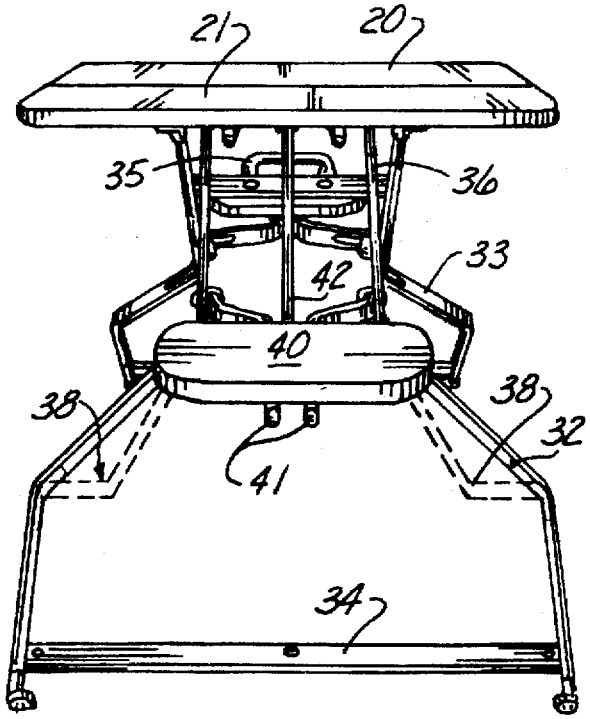
FIG. 3 is a front elevation view of the first version of the apparatus in the operative mode.
Figure 4:
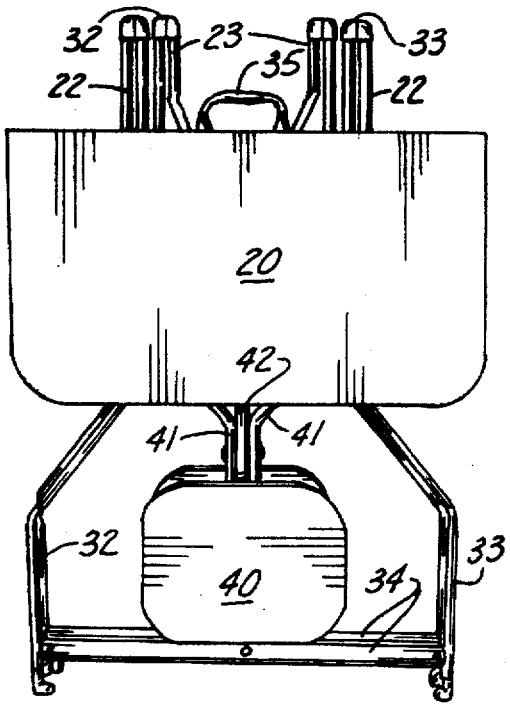
FIG. 4 is a front elevation view of the first version of the apparatus depicted in the collapsed mode.

Referring to FIGS. 3 thru 5, it can be seen that the table support unit 12 comprises a first pair of outer elongated contoured support legs 32 and a second pair of inner contoured support legs 33 wherein the first and second pairs of support legs 32 and 33 are pivotally secured to one another as at 31. In addition, each pair of support legs 32 and 33 have a flared portion disposed proximate to, but spaced from, their lower ends. The lower ends of each pair of support legs 32 and 33 are provided with stiffening cross piece member 34; and, a handle element 35 is disposed on a cross-piece element 36 which extends between the upper portion of the support legs 33.

Figure 2:
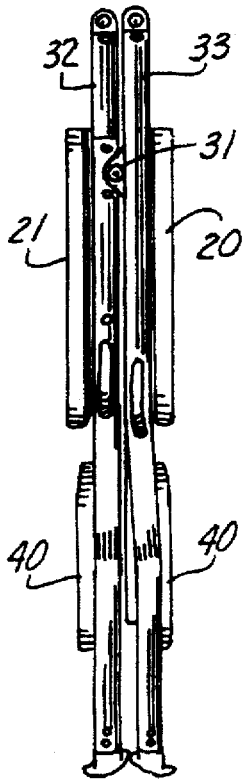
FIG. 2 is a side elevation view of the first version of the apparatus in the collapsed mode.

As can best be seen by reference to FIGS. 2 and 4, the free ends of the generally straight support arms 22 are pivotally secured to the upper ends of the elongated pair of support legs 33 and the free ends of the contoured table support arms 23 are pivotally connected to the upper ends of the support legs 32.

As shown in FIGS. 1 thru 5, the seat unit 13 comprises a pair of seat members 40 wherein each seat member 40 is fixedly secured to the outboard ends of a pair of contoured seat support arms 41 wherein the inboard ends of the seat support arms 41 are pivotally secured to the elongated support legs 32 and 33 respectfully. In addition, an angled seat brace element 42 has a lower end pivotally secured to the intermediate portion of the seat support arms 41 and an upper end pivotally secured to the contoured table support arms 22.

As can best be appreciated by reference to FIGS. 2 through 5, both pairs of support legs 32, 33, the seat support arms 41 and the contoured table support arms 23 have the same general overall configuration which includes a somewhat narrow parallel portion, and outwardly flared intermediate portion and a generally wide parallel portion wherein the contoured portions are dimensioned and designed to cooperate with one another in a generally nesting fashion to produce the smallest possible storage profile for the combined table and chair apparatus 10.

To that end the upper portion of the seat brace element 42 nests between the contoured table support arms 23. The contoured table support arms 23 nest between the seat support arms 41 and the table support legs 32. The relatively elongated table support legs 32 nest between the relatively short table support legs 33. Furthermore, all of the support arms and legs, as well as the brace element, have the same width and all of the pivoted connections are vertically aligned when the combined table and chair apparatus 10 is disposed in the collapsed mode as shown in FIG. 2.

As a consequence of the foregoing situation, the total width of the preferred version of the table and chair apparatus equals the combined width of the support legs 32, 33 plus the combined thickness of both table top halves 20 and 21, which is the smallest possible structural storage profile that can be achieved for a two piece collapsible table let alone the combined table and chair apparatus that forms the basis of the present invention.

Figure 7:
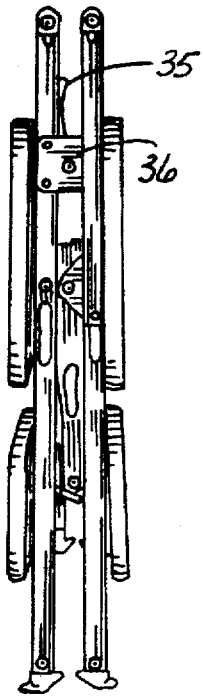
Figure 6:
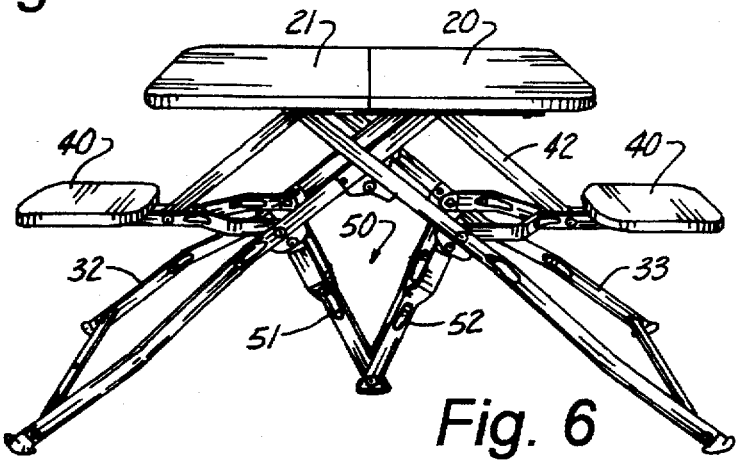
FIG. 6 is a perspective view of the second version of the combined table and chair apparatus: and, FIG. 7 is a side elevation view of the second version of the apparatus in the collapsed mode.

In the alternate version of the preferred embodiment depicted in FIGS. 6 and 7, the only significant structural difference involves an auxiliary leg assembly 50 comprising a pair of relatively short auxiliary leg members 51 and 52 wherein the auxiliary leg members 51, 52 ate pivotally connected to one another on their lower ends; and, pivotally connected on their upper ends relatively to the pairs of support legs 32 and 33 proximate the pivoted connection of the seat support arms 41 with the support legs 32, 33.

It should also be noted that each of the auxiliary leg members 51 and 52 comprise a pair of contoured leg elements wherein the pair of leg elements of auxiliary leg members 51 are dimensioned to be received within the pair of leg elements of auxiliary leg member 52.

It should further be noted that the preferred embodiment of the invention depicted in FIGS. 1 thru 5 is designed for use with children; whereas, the alternate version depicted in FIGS. 6 and 7 is designed for adults and requires the presence of the auxiliary leg assembly. Furthermore, as shown in the dashed line portion of FIG. 3, this invention also contemplates the provision of stepped shoulders 38 on each pair of support legs 32, 33 such that the stepped shoulders 38 may serve as a foot rest for the users.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A collapsible table and chair apparatus comprising:

a table unit including two table top halves wherein each table top half is provided with a pair of table support arms;

a table support unit including a first pair of support legs and a second pair of support legs; wherein, the support legs are pivotally connected to one another and each pair of table support arms are pivotally connected to one of the pair of support legs; and a seat unit including at least one seat member provided with a pair of seat support arms, which are pivotally connected to one of said pairs of support legs; and means connected with said seat unit for maintaining said at least one seat member in a horizontal disposition when said seat unit is deployed in the operative mode, wherein at least one of said pair of table support arms, both of said pairs of table support legs, and said pair of seat support arms are provided with the same generally contoured configuration which includes: a generally narrow parallel portion; an outwardly flared intermediate portion; and a generally wide parallel portion.

2. The apparatus as in claim 1 wherein said means comprises:

a seat brace element pivotally secured on one end to said pair of seat support arms and pivotally secured on the other end to a portion of said table unit.

3. The apparatus as in claim 2 wherein the seat brace element is pivotally secured on said other end to one of said pair of table support arms.

4. The apparatus as in claim 1 wherein the contoured pair of seat support arms and the pair of contoured table support arms nest between one of the pairs of tale support legs.

5. A collapsible table and chair apparatus comprising:

a pair of table top halves wherein each table top half is pivotally associated with a selected one of two pairs of support legs including a first pair of support legs and a second pair of support legs wherein said pairs of support legs are pivotally connected to one another;

a pair of seat members wherein each seat member is pivotally associated with one of said pairs of support legs and provided with means for maintaining said seat member in a fixed position relative to said one of said pairs of support legs; and an auxiliary leg assembly pivotally connected to said two pairs of support legs and including a pair of relatively short leg members connected to one another, wherein, each of said relatively short leg members comprise a pair of contoured leg elements, and wherein one of said pair of contoured leg elements is dimensioned to be received within the other pair of contoured leg elements.

6. The apparatus as in claim 5, wherein, each table top half is provided with a pair of support arms having an outboard end rigidly secured thereto and an inboard end pivotally connected to one of said pair of support legs.

7. The apparatus as in claim 6, wherein, the outboard ends of the support arms of one table top half substantially overlaps the inboard ends of the support arms of the other table top half.

* * * * *